US008015736B2

(12) United States Patent
Frey

(10) Patent No.: US 8,015,736 B2
(45) Date of Patent: Sep. 13, 2011

(54) DUAL PANEL-FRAME INTERFACE SYSTEM

(75) Inventor: Robert M. Frey, Salt Lake City, UT (US)

(73) Assignee: Moss, Inc., Salt Lake City, UT (US)

( * ) Notice: Subject to any disclaimer, the term of this patent is extended or adjusted under 35 U.S.C. 154(b) by 219 days.

(21) Appl. No.: 12/607,044

(22) Filed: Oct. 27, 2009

(65) Prior Publication Data

US 2011/0094135 A1 Apr. 28, 2011

(51) Int. Cl.
*G09F 13/00* (2006.01)

(52) U.S. Cl. ..... 40/549; 40/606.18; 40/611.01

(58) Field of Classification Search ..... 40/549, 40/700, 606.18, 606.01, 611.01
See application file for complete search history.

(56) References Cited

U.S. PATENT DOCUMENTS

| | | | | |
|---|---|---|---|---|
| 3,700,385 | A | 10/1972 | Sherwood | |
| 4,166,332 | A | 9/1979 | Donovan | |
| 4,217,714 | A * | 8/1980 | Ramsay | 40/549 |
| 4,656,766 | A | 4/1987 | Cooper | |
| 4,882,866 | A * | 11/1989 | Gebhardt | 40/611.01 |
| 4,905,428 | A | 3/1990 | Sykes | |
| 4,907,388 | A | 3/1990 | Siahatgar | |
| 5,305,567 | A | 4/1994 | Wittler | |
| 5,377,434 | A | 1/1995 | Wilson | |
| 6,141,926 | A | 11/2000 | Rossiter et al. | |
| 6,368,011 | B1 * | 4/2002 | LaFountain et al. | 403/363 |
| 6,415,568 | B1 | 7/2002 | Lingenfelder et al. | |
| 6,494,247 | B1 | 12/2002 | Pedone | |
| 6,658,776 | B1 | 12/2003 | Pynenburg et al. | |
| 2006/0042141 | A1 | 3/2006 | Hansen et al. | |
| 2010/0202827 | A1 | 8/2010 | Frey | |
| 2010/0236116 | A1 * | 9/2010 | Gimpel et al. | 40/606.03 |

* cited by examiner

*Primary Examiner* — Gary Hoge
(74) *Attorney, Agent, or Firm* — Lance M. Pritikin

(57) ABSTRACT

A dual panel-frame interface system for the construction of portable displays comprises one or more frame members and one or more panel members. Each frame member is adapted to accommodate the releasable connection of two general types of panel members. One type of panel member is generally flexible with mounting gaskets flexibly connected to its peripheral edge for receiving engagement by a mounting groove in the frame member. The other type of panel member is a more rigid, face-mounted type that is placed in clinging engagement directly with a lateral wall of the frame member. The frame member is adapted such that when a rigid type panel member is placed in clinging engagement with the lateral wall, the respective unused mounting groove remains visually obscured from a viewpoint outward of the outer surface of the panel member, thus making the system more visually appealing. Frame members of embodiments may also include inboard and outboard lipped channels to accommodate auxiliary members or accessories, such as lighting systems, wiring tracks, sound absorption blankets and display support elements.

19 Claims, 6 Drawing Sheets

PRIOR ART

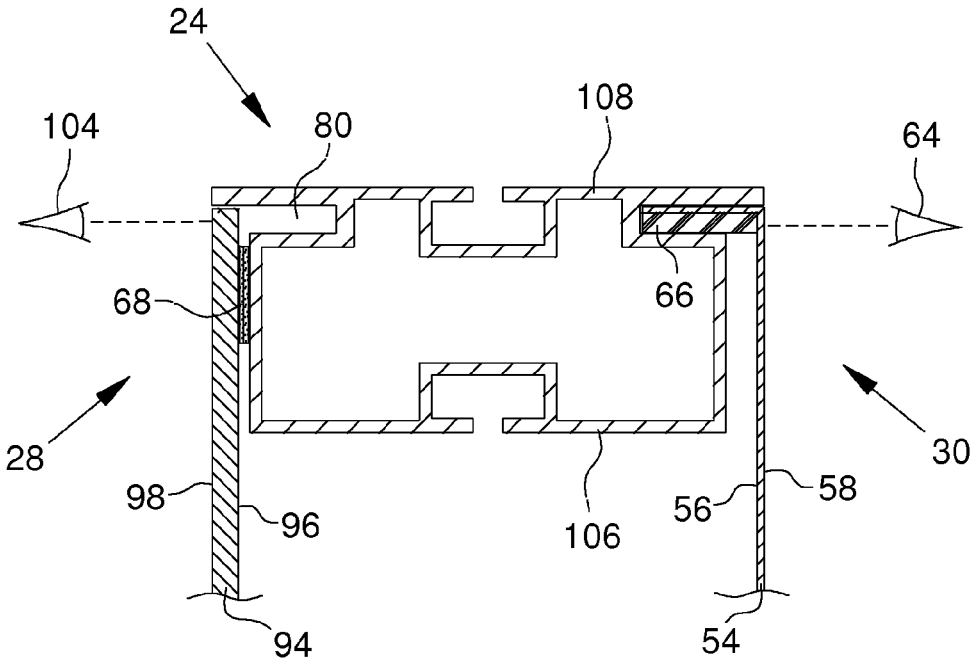
Fig. 10
Fig. 11
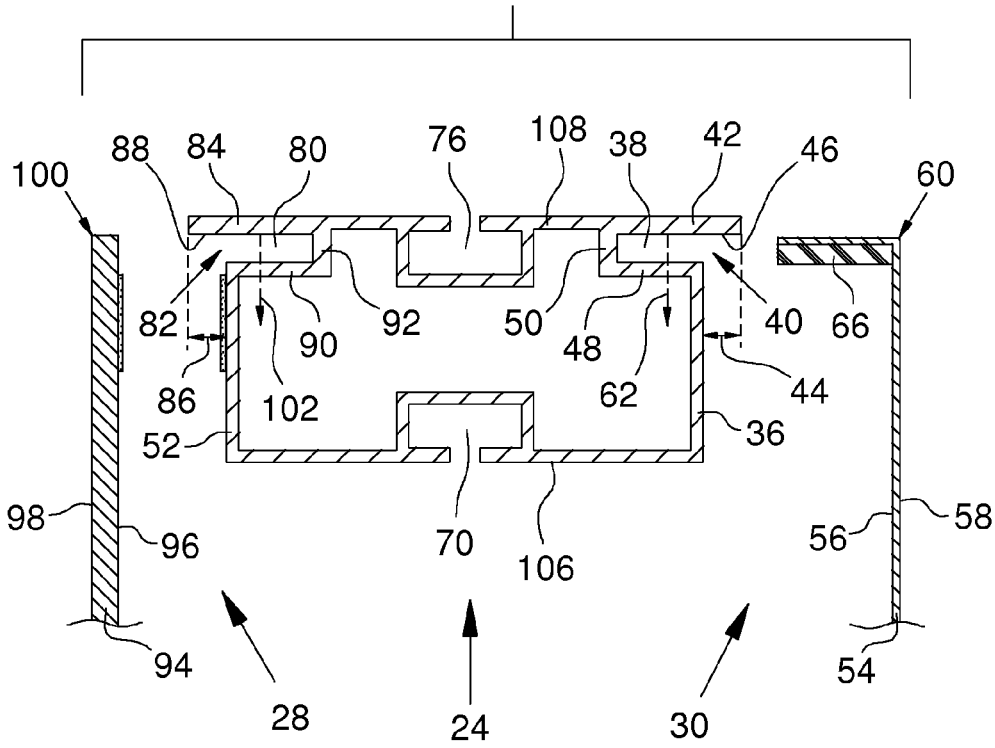

DUAL PANEL-FRAME INTERFACE SYSTEM

RELATED APPLICATIONS

Not Applicable.

TECHNICAL FIELD OF THE INVENTION

The present invention relates generally to the field of portable display systems. More particularly, the invention concerns portable display systems comprising a framework to which display panels are attached, such as those commonly used for decoration and advertising in retail establishments, trade shows, and the like.

BACKGROUND OF THE INVENTION

Frame and panel interface systems are commonly used to construct displays in homes, museums, retail stores, airport terminals, trade show exhibits and the like. In the trade show and retail environment, it is particularly important that the entire display be visually appealing and not present features which would distract the attention of prospective customers away from the information and designs displayed on the panels. Because frame and panel systems are frequently used in conjunction with portable display assemblies at trade shows, where time and space can be very limited, a preferable panel-frame interface system is one in which the same frame members can be used to support more than one type of panel without resulting in the exposure of unsightly structural features.

Solutions exist for panel-frame interface systems, particularly those using frame members formed by extruding cross-sectional profiles and which include lateral portions adapted to supporting a panel member. Such systems typically comprise frame members that are designed to support either rigid planar panel members in an attractive manner or flexible panel members with mounting gaskets at their periphery in an attractive manner, but generally not both. Conventional frame members that are designed to support flexible panel members with mounting gaskets generally have a mounting groove which projects laterally outward of the respective lateral face of the frame member. Insertion of the mounting gaskets into the mounting groove of a frame member provides the principle means of support for the flexible panel member. The opposing walls of the conventional mounting groove commonly terminate at approximately the same distance outward of the respective lateral face of the frame member. This structural attribute typical in the prior art presents a significant disadvantage if a frame member with the described conventional mounting groove is to be used to support a rigid panel member without mounting gaskets, because the groove opening will remain visibly exposed, a characteristic which those in the art recognize as unsightly and therefore highly undesirable in display system applications.

Those in the art have long recognized the need for an improved panel-frame interface system in which the same frame members can attractively support both flexible panel members with mounting gaskets at their periphery designed to be receivingly engaged by a mounting groove in the frame member and rigid panel members designed to clingingly engage the lateral wall of the frame member while visually obscuring the unused mounting groove.

SUMMARY OF THE INVENTION

By way of summary, embodiments concern a dual panel-frame interface system wherein a frame member is adapted to accommodate the attachment of both rigid and flexible panel member types without visibly exposing the mounting groove disposed within the frame member. This is an important characteristic, because aesthetic appeal is crucial in advertising, retail and trade show environments.

A dual panel-frame interface system for use in constructing portable displays comprises a frame member in first releasable connection with a first panel member. The frame member is elongated and hollow, and includes a substantially constant cross-sectional profile, a first lateral wall and a first mounting groove. The first mounting groove is disposed inwardly of the first lateral wall, and has a first lateral opening disposed substantially at the first lateral wall. The first lateral opening is disposed between the first lateral wall and a first distal groove wall. The first distal groove wall extends to a first distance outward of the first lateral wall and has a first distal face generally facing the first lateral opening. The first panel member includes a first display portion. The first display portion has a first inner surface and a first outer surface. The first outer surface extends to a first panel peripheral edge. The first panel member is in first releasable connection with the frame member such that the first panel peripheral edge is approximately adjacent to the first distal face, the first panel member is generally disposed outward from the first distal face, and the first lateral opening is visually obscured by the first panel member from a viewpoint outward of the first outer surface.

A frame member of certain embodiments may further include a second lateral wall and a second mounting groove. In such a frame member the second mounting groove is disposed inwardly of the second lateral wall, and has a second lateral opening disposed substantially at the second lateral wall. The second lateral opening is disposed between the second lateral wall and a second distal groove wall. The second distal groove wall extends to a second distance outward of the second lateral wall and has a second distal face generally facing the second lateral opening.

Particular embodiments further comprise a second panel member including a second display portion. The second display portion has a second inner surface and a second outer surface. The second outer surface extends to a second panel peripheral edge. The second panel member is in second releasable connection with the frame member such that the second panel peripheral edge is approximately adjacent to the second distal face, the second panel member is generally disposed outward from the second distal face, and the second lateral opening is visually obscured by the second panel member from a viewpoint outward of the second outer surface.

In embodiments, the first releasable connection is by way of either clinging engagement between the first lateral wall and first inner surface, or receiving engagement between the first mounting groove and one or more mounting gaskets flexibly connected to the first panel peripheral edge. Likewise, in embodiments with a second releasable connection, the second releasable connection is by way of either clinging engagement between the second lateral wall and second inner surface, or receiving engagement between the second mounting groove and one or more mounting gaskets flexibly connected to the second panel peripheral edge In particular embodiments, the clinging engagement is achieved by way of one or more hook-and-loop fastener elements. In further embodiments, as a result of the first releasable connection between the first panel member and frame member, the first panel peripheral edge is approximately adjacent the first distal face at approximately said first distance. Similarly, in embodiments that include a second panel member, as a result of the second releasable connection between the second panel member and frame member, the second panel peripheral edge is approximately adjacent the second distal face at approximately the second distance.

In certain embodiments, the frame member includes an inboard lipped channel. Such embodiments may further comprise an auxiliary member, such as a sound absorption blanket, a light blocking blanket or light source, partially receivingly engaged by the inboard lipped channel. In further embodiments the frame member includes an outboard lipped channel.

Embodiments may comprise two or more frame members. In such a case, the first panel member is in first releasable connection with each frame member, and where an embodiment comprises a second panel member, the second panel member is in second releasable connection with each frame member. In embodiments with four frame members, the frame members may be rectangularly interconnected.

In particular embodiments, a frame member may include a longitudinal axis that is curved. In such an embodiment, the substantially constant cross-sectional profile of the frame member will follow a curved path traced by its respective longitudinal axis, resulting in the frame member itself being curved. A frame member of certain embodiments may further include a first proximal groove wall disposed inward of the first lateral wall and generally opposite of the first distal groove wall. Likewise, a frame member of other embodiments may further include a second proximal groove wall disposed inward of the second lateral wall and generally opposite of the second distal groove wall.

BRIEF DESCRIPTION OF THE DRAWINGS

Further advantages of the present invention may become apparent to those skilled in the art with the benefit of the following detailed description of the preferred embodiments and upon reference to the accompanying drawings in which:

FIG. 10 is a cross-sectional view of a further embodiment in accordance with the present invention, in which panel members of two different types are in releasable connection with a frame member by way of clinging engagement and receiving engagement, respectively;

FIG. 11 is a diagrammatic exploded cross-sectional view of the embodiment depicted in FIG. 10;

Figure 1:
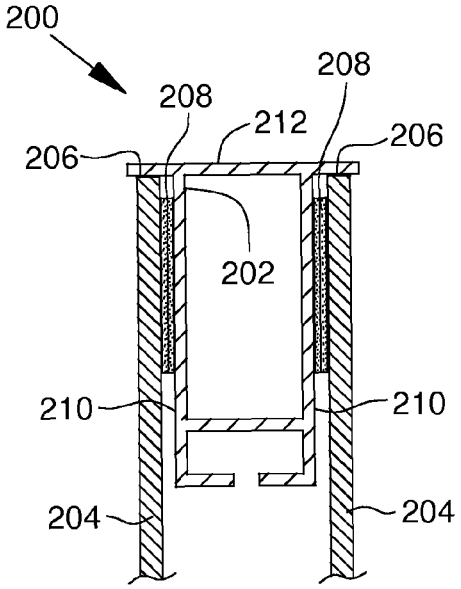
Fig. 1 PRIOR ART
FIG. 1 is a diagrammatic cross-sectional view of a prior art panel-frame system in which rigid panels are attached to a frame member that lacks a mounting groove for receiving a mounting gasket of a flexible panel type.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications.

DETAILED DESCRIPTION OF THE INVENTION

Referring now to the drawings, like reference numerals designate identical or corresponding features throughout the several views.

Figure 2:
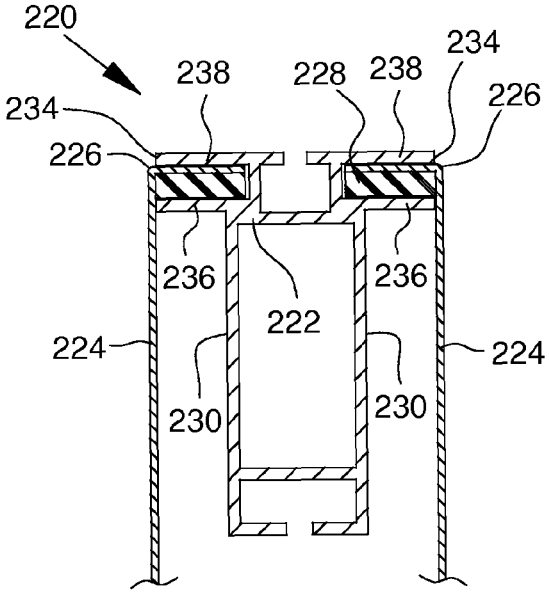
Fig. 2 PRIOR ART
FIG. 2 is a diagrammatic cross-sectional view of a second prior art panel-frame system in which the frame member includes conventional mounting grooves for receiving mounting gaskets of a flexible panel type, the opposing walls of each conventional mounting groove terminating at the same distance outward of their respective adjacent lateral face.
Figure 3:
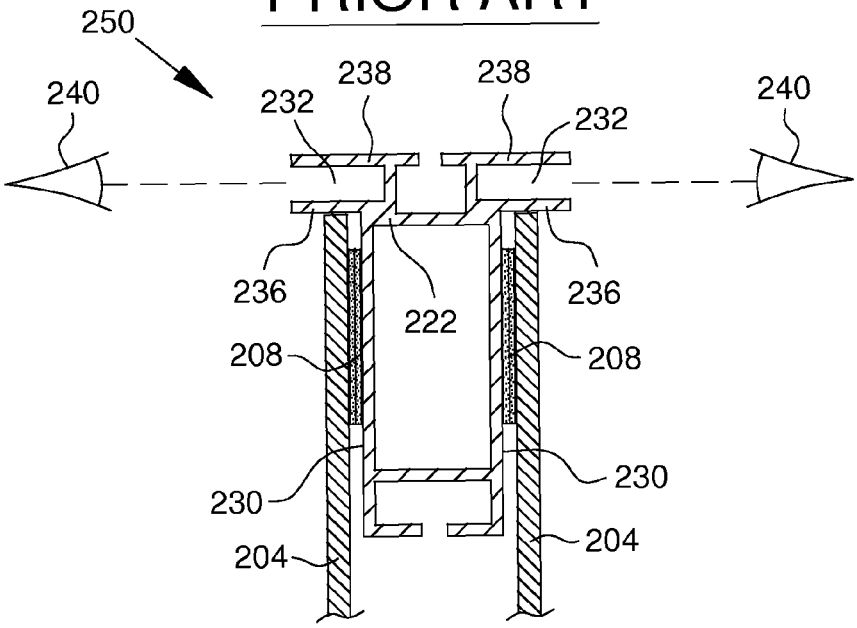
FIG. 3 is a diagrammatic cross-sectional view of a third prior art panel-frame system illustrating how applying the rigid panels shown in FIG. 1 to the prior art frame member shown in FIG. 2 results in the mounting grooves remaining exposed from viewpoints outward of the respective panels.

FIGS. 1-3 depict cross-sectional views of various conventional panel-frame systems to facilitate the contrasting of such systems to those of the present invention. FIG. 1 depicts a conventional panel-frame system shown generally at 200 including two rigid panel members 204 clingingly engaged to respective lateral walls 210 of the frame member 202 by way of hook and loop fasteners 208. With this particular system, the outer edges 206 of the panel members 204 generally abut respective walls extending laterally from outboard portion 212 of the frame member 202. The frame member 202 of the panel-frame system shown generally at 200 lacks mounting grooves for accommodating the releasable connection of a flexible panel member with a mounting gasket at its periphery (such as those shown, for example, at 224 in FIG. 2).

FIG. 2 depicts a cross-sectional view of a further conventional panel-frame system shown generally at 220, in which the frame member 222 includes two mounting grooves 232 (see FIG. 3) each defined by a proximal groove wall 236 and a distal groove wall 238. The flexible panel members 224 are in each placed in releasable connection with the frame member 222 by way of a mounting gasket 228 being inserted into a respective mounting groove 232. As shown, the proximal groove wall 236 and the distal groove wall 238 both terminate at the same distance outward of their respective lateral walls 230, causing the peripheral edge 226 of respective panel member 224 to protrude outward of the end 234 of the distal groove wall 238 in a manner that may be considered unsightly. More notably, as shown in FIG. 3, when the rigid panel members 204 are connected to the lateral walls 230 of the conventional frame member 222, a conventional panel-frame system shown generally at 250 is created in which the mounting grooves 232 remain visibly exposed from viewpoints 240 outward of the panel members 204, a feature which those in the art recognize as unsightly and therefore highly undesirable in the display industry.

Figure 4:
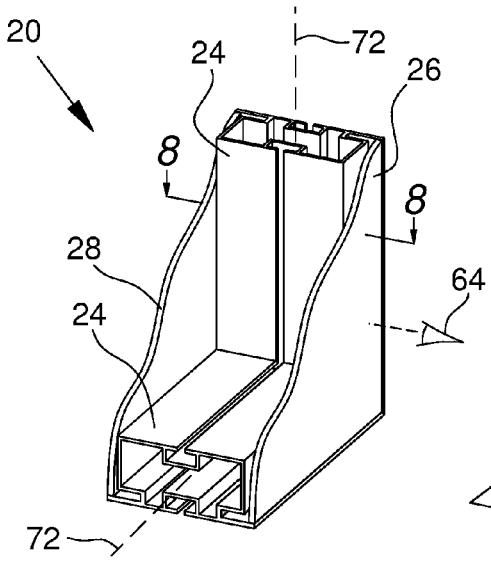
FIG. 4 is a broken perspective view of a dual panel-frame interface system in accordance with the present invention, in which two frame members are joined at a right angle, and two panel members of the rigid type are in releasable connection with the frame members by way of clinging engagement.
Figure 5:
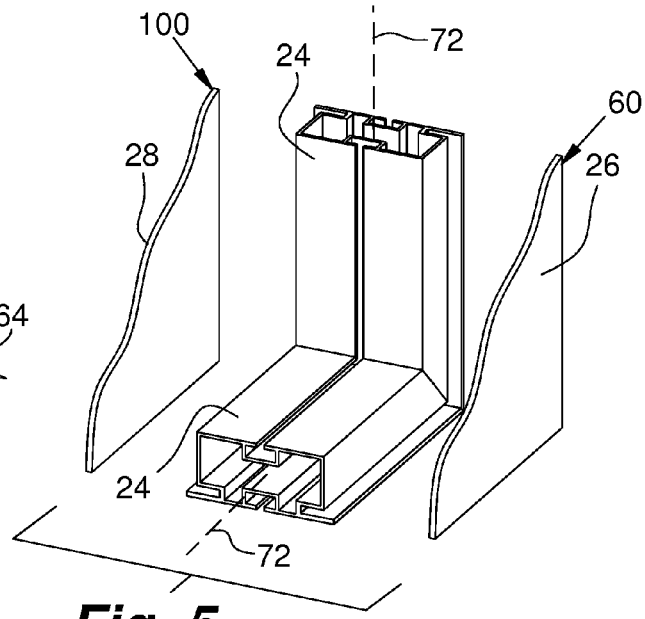
FIG. 5 is a partially exploded broken perspective view of the embodiment depicted in FIG. 4.
Figure 6:
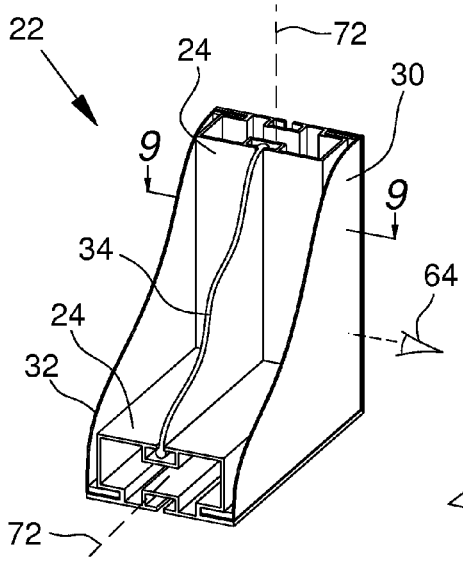
FIG. 6 is a broken perspective view of a dual panel-frame interface system in accordance with the present invention, in which two frame members are joined at a right angle, two panel members of the flexible type are in releasable connection with the frame members by way of receiving engagement at the mounting grooves of the frame members, and an auxiliary member is partially receivingly engaged by an inboard lipped channel in the frame members.
Figure 14:
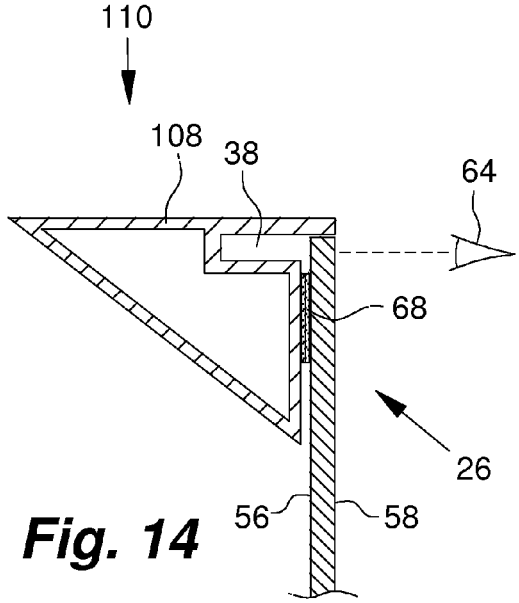
FIG. 14 is a diagrammatic cross-sectional view of a further embodiment of a dual panel-frame interface system in accordance with the present invention.
Figure 15:
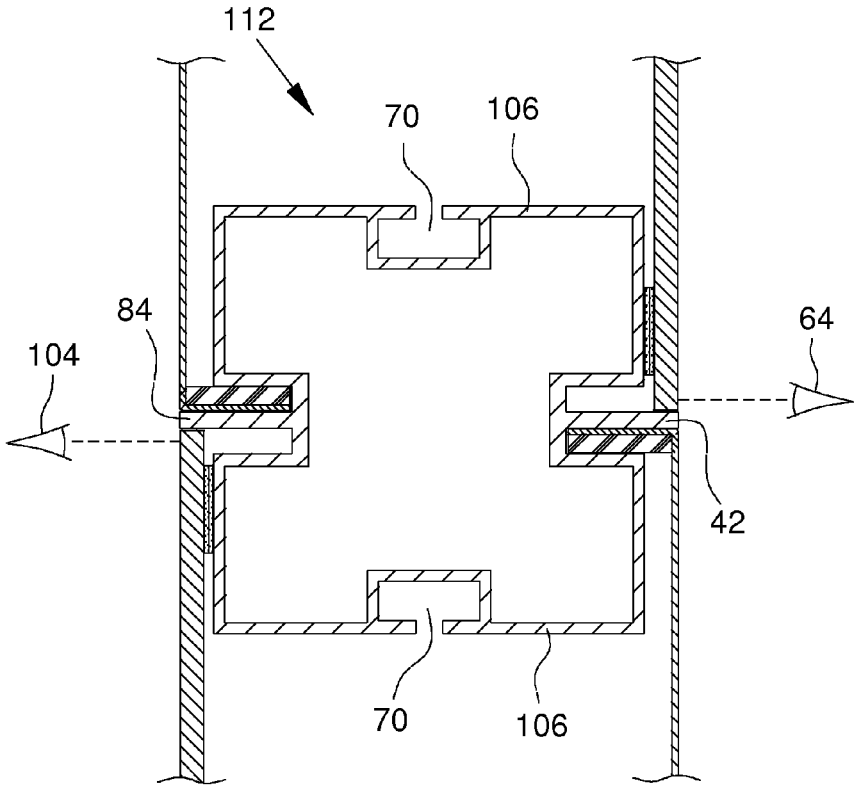
FIG. 15 is a diagrammatic cross-sectional view of a another embodiment of a dual panel-frame interface system in accordance with the present invention, in which the frame member is adapted to accommodate the releasable connection of four panel members of mixed types.
Figure 16:
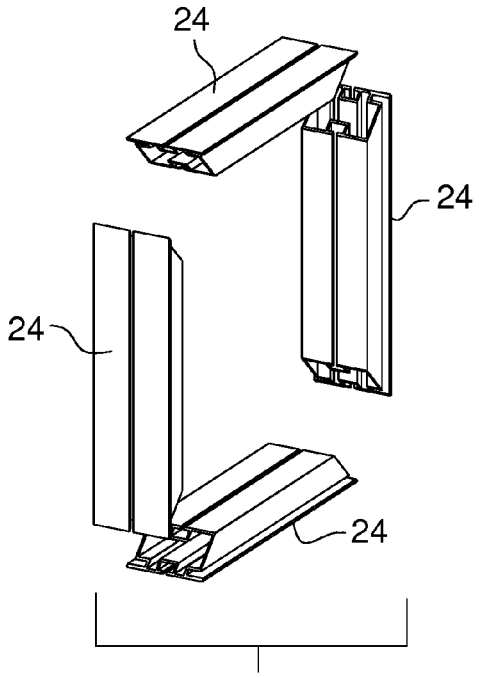
FIG. 16 is an exploded perspective view of four frame members in accordance with the present invention.
Figure 17:
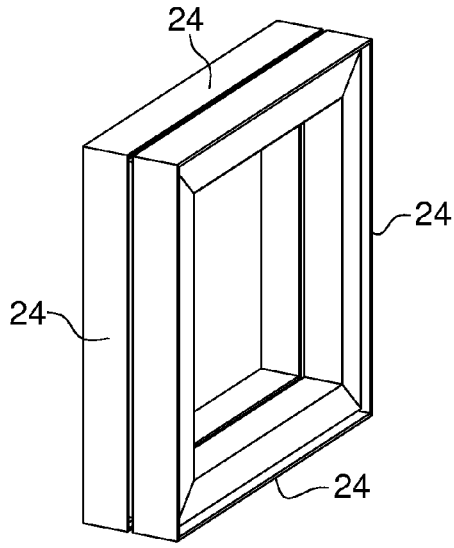
FIG. 17 is a perspective view of four frame members rectangularly interconnected in accordance with the present invention.
Figure 19:
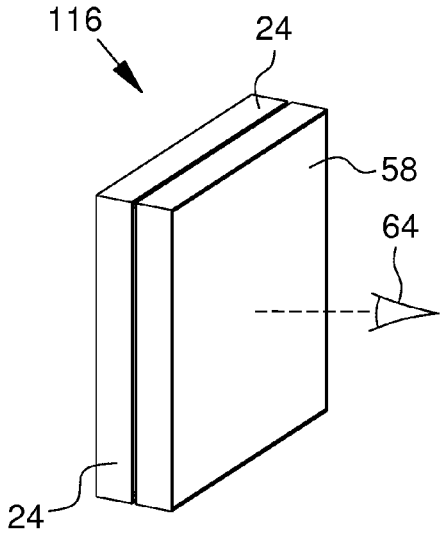
FIG. 19 is a collapsed perspective view of the embodiment depicted in FIG. 18.

Turning to FIGS. 4, 6 and 19, embodiments of a dual panel-frame interface system according to the present invention comprising two panel members are shown generally at 20, 22 and 116, respectively. Additionally, cross-sectional views of other embodiments are shown, for example, in FIGS. 14 and 15. FIG. 14 illustrates a dual panel-frame interface system which accommodates the connection of one panel member to a frame member 110. FIG. 15 illustrates a dual panel-frame interface system which accommodates the releasable connection of four panel members to a frame member 112.

FIG. 4 illustrates a portion of an embodiment of a dual panel-frame interface system shown generally at 20 in which two frame members 24 are joined at a right angle, and panel members 26 and 28, which are typically of the rigid, face-mounted type that lack mounting gaskets, are in releasable connection with each frame member 24. FIG. 6 depicts a similar embodiment of a dual panel-frame interface system shown generally at 22 but where the panel members 30 and 32 are of a variety which are typically thinner, more flexible and include mounting gaskets 66 at their peripheral edges by which the panel members are placed in releasable connection with each frame member 24. The frame members 24 are each hollow, elongated along a longitudinal axis 72 and include a substantially constant cross-sectional profile (see, for example, 24 in FIG. 8). The frame members 24 may be interconnected, for example, by weld joint, adhesive, other conventional attachment means, tension-lock mechanisms or one of the Applicant's mitered corner connection systems.

Turning briefly to FIG. 11, the cross-sectional profile of the frame member 24 of a typical embodiment is depicted in the greatest referenced detail. To accommodate the connection of a first panel member 26 or 30 (each representing an alternate panel type), the frame member 24 includes a first lateral wall 36, a first mounting groove 38 disposed inwardly thereof with a first lateral opening 40 disposed substantially thereat. That is to say, the first lateral opening 40 is disposed at approximately the plane defined by the first lateral wall 36. The first lateral opening 40 is disposed between the first lateral wall 36 and a first distal groove wall 42. The first distal groove wall 42 extends to a first distance 44 outward of the first lateral wall 36 and has a first distal face 46 generally facing the first lateral opening 40.

Similarly, to accommodate the releasable connection of a second panel member 28 or 32 (each representing an alternate panel type), the frame member 24 includes a second lateral wall 52, a second mounting groove 80 disposed inwardly thereof with a second lateral opening 82 disposed substantially thereat. That is to say, the second lateral opening 82 is disposed at approximately the plane defined by the second lateral wall 52. The second lateral opening 82 is disposed between the second lateral wall 52 and a second distal groove wall 84. The second distal groove wall 84 extends to a second distance 86 outward of the second lateral wall 52 and has a second distal face 88 generally facing the second lateral opening 82.

Turning to FIGS. 8-11 for illustration, first panel members 26 and 30 include a first display portion 54 having a first inner surface 56 and a first outer surface 58. The first outer surface 58 extends to a first panel peripheral edge 60. In embodiments, the first panel peripheral edge 60 traces around the entire periphery of the first outer surface 58. Similarly, second panel members 28 and 32 include a second display portion 94 having a second inner surface 96 and a second outer surface 98. The second outer surface 98 extends to a second panel peripheral edge 100. In embodiments, the second panel peripheral edge 100 traces around the entire periphery of the second outer surface 98.

Figure 8:
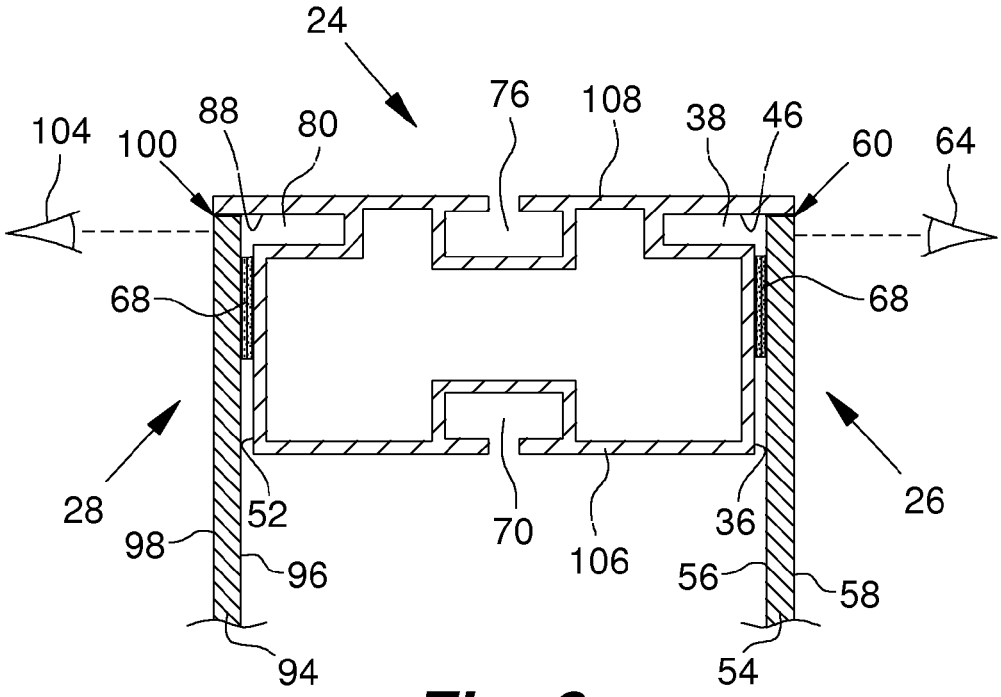
FIG. 8 is a diagrammatic cross-sectional view taken along line 8-8 of FIG. 4.
Figure 18:
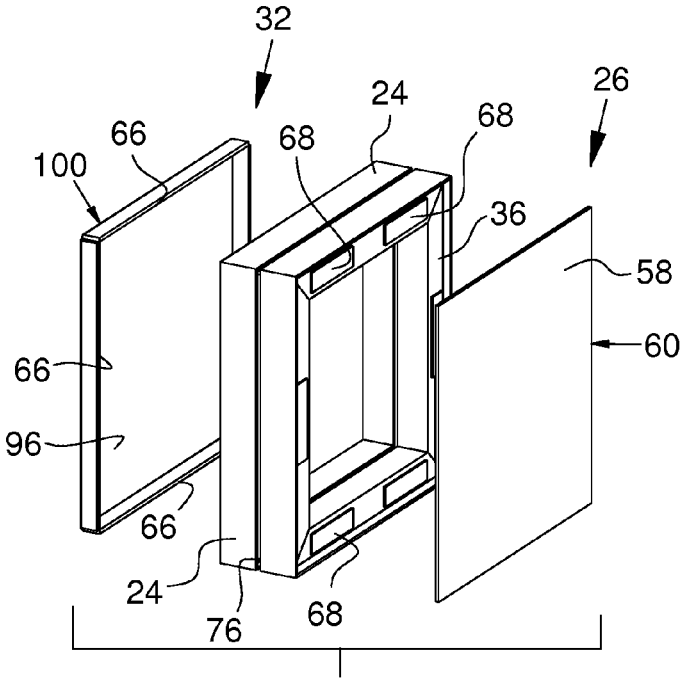
FIG. 18 is an exploded perspective view of another panel-frame interface system in accordance with the present invention, in which four frame members are rectangularly interconnected, panel members of two different types are in releasable connection with each frame member, and the lateral openings of each mounting groove are visually obscured from a viewpoint outward of the outer surface of each respective panel member.

Turning now to the embodiment illustrated in FIGS. 4 and 8, the first panel member 26 is in first releasable connection with frame member 24 such that the first panel peripheral edge 60 is approximately adjacent the first distal face 46, the first panel member 26 is generally disposed outward of the first distal face 46 (the outward direction being generally shown at 62 in FIG. 11), and the first lateral opening 40 is visually obscured by the first panel member 26 from a viewpoint 64 outward of the first outer surface 58. Similarly, the second panel member 28 is in second releasable connection with frame member 24 such that the second panel peripheral edge 100 is approximately adjacent the second distal face 88, the second panel member 28 is generally disposed outward of the second distal face 88 (the outward direction being generally shown at 102 in FIG. 11), and the second lateral opening 82 is visually obscured by the second panel member 28 from a viewpoint 104 outward of the second outer surface 98. In the embodiment shown in FIGS. 4 and 8, the first releasable connection is by way of clinging engagement between the first lateral wall 36 and the first inner surface 56. Similarly, the second releasable connection is by way of clinging engagement between the second lateral wall 52 and the second inner surface 96. The clinging engagement may be made by means such as hook and loop fastener elements 68, magnets, double-sided tape, or other conventional face-to-face attachment means. Such attachment means as the hook and loop fasteners 68 are typically applied as single continuous strips that nearly span the length of a frame member, but can also be applied in smaller sections or pieces (as shown, for example, in FIG. 18).

Figure 9:
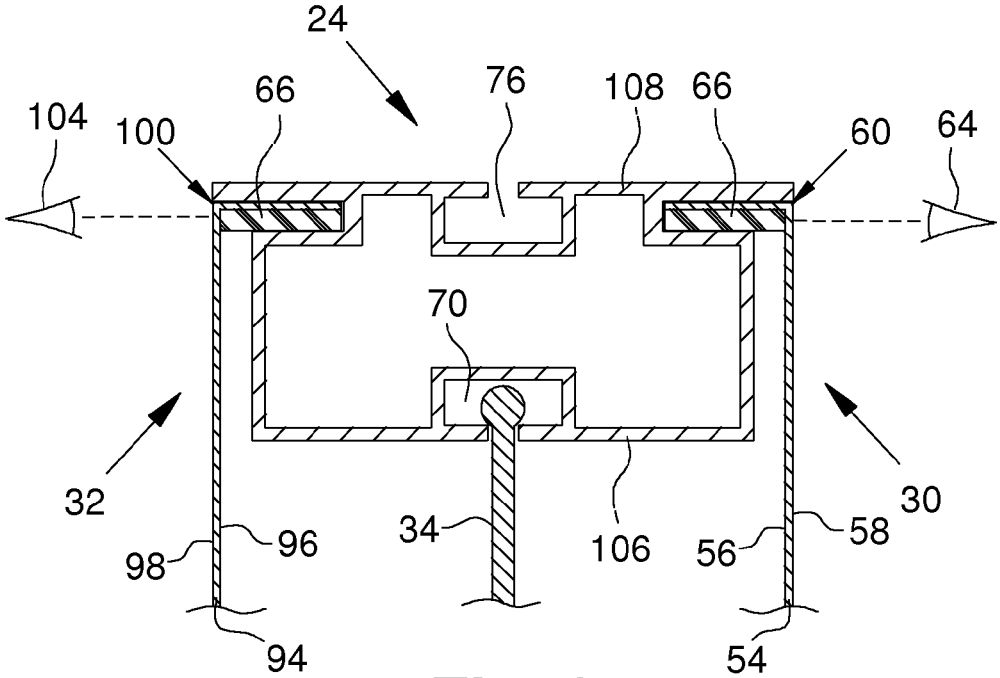
FIG. 9 is a diagrammatic cross-sectional view taken along line 9-9 of FIG. 6.

Turning to the embodiment illustrated in FIGS. 6 and 9, the first panel member 30 is in first releasable connection with frame member 24 such that the first panel peripheral edge 60 is approximately adjacent the first distal face 46 (see FIG. 11), the first panel member 30 is generally disposed outward of the first distal face 46 (the outward direction being generally shown at 62 in FIG. 11), and the first lateral opening 40 is visually obscured by the first panel member 30 from a viewpoint 64 outward of the first outer surface 58. Similarly, the second panel member 32 is in second releasable connection with frame member 24 such that the second panel peripheral edge 100 is approximately adjacent the second distal face 88 (see FIG. 11), the second panel member 32 is generally disposed outward of the second distal face 88 (the outward direction being generally shown at 102 in FIG. 11), and the second lateral opening 82 is visually obscured by the second panel member 32 from a viewpoint 104 outward of the second outer surface 98. In the embodiment shown in FIGS. 6 and 9, the first releasable connection is by way of receiving engagement between the first mounting groove 38 and one or more mounting gaskets 66 flexibly connected to the first panel peripheral edge 60. Similarly, the second releasable connection is by way of receiving engagement between the second mounting groove 80 and one or more mounting gaskets 66 flexibly connected to the second panel peripheral edge 100. This receiving engagement generally results in a frictional bond between the mounting gaskets and their respective mounting grooves.

Figure 12:
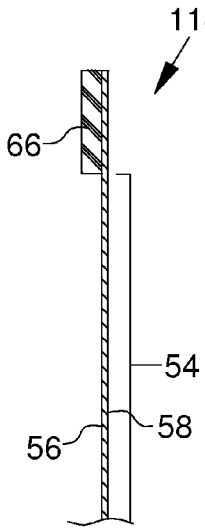
FIG. 12 is a diagrammatic broken cross-sectional view of a precursor panel member with a mounting gasket.
Figure 13:
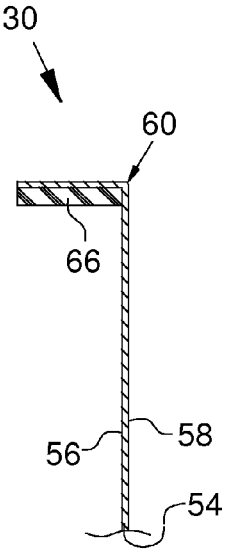
FIG. 13 is a diagrammatic broken cross-sectional view of the panel member similar to that depicted in FIG. 12, but in which the mounting gasket is rotated, illustrating how the mounting gasket is flexibly connected to the panel peripheral edge.

FIG. 10 depicts a cross-sectional view of an embodiment of a dual panel-frame interface system in which two different types of panel members are attached to a frame member 24. First panel member 30 is typically of the flexible type that includes one or more mounting gaskets 66 flexibly connected to the first panel peripheral edge 60. Second panel member 28 is typically of the rigid, planar type that lacks a mounting gasket and is designed to be face-mounted to the respective frame member. FIGS. 12 and 13 illustrate how first panel peripheral edge 60 is formed in a panel member of the type shown at 30. FIG. 12 depicts a precursor of first panel member 30 generally at 114, prior to the rotation of the mounting gasket 66 with respect to the first display portion 54. FIG. 13 depicts first panel member 30 after rotation of the mounting gasket 66 into mounting position, generally perpendicularly to first display portion 54, thereby forming a section of first panel peripheral edge 60. The mounting gasket 66 is commonly made into an integral part of the panel member of the type shown generally at 30 by way of a stitching operation. Further, the panel member of the type shown at 30, particularly the first display portion 54, is commonly comprised primarily of a fabric.

In embodiments such as those shown throughout the several drawings, as a result of the first releasable connection, the first panel peripheral edge 60 is typically positioned approximately adjacent the first distal face 46 at approximate the first distance 44. Similarly, as a result of the second releasable connection, the second panel peripheral edge 100 is typically positioned approximately adjacent the second distal face 88 at approximately the second distance 86.

As illustrated particularly in FIG. 11, the frame member 24 may include, alternatively or in various combinations, a first proximal groove wall 48, a first groove inner portion 50, a second proximal groove wall 90, a second groove inner portion 92, an inboard portion 106 and an outboard portion 108. The first proximal groove wall 48 is disposed inward of the first lateral wall 36 and generally opposite the first distal groove wall 42. Similarly, the second proximal groove wall 90 is disposed inward of the second lateral wall 52 and generally opposite the second distal groove wall 84.

Figure 7:
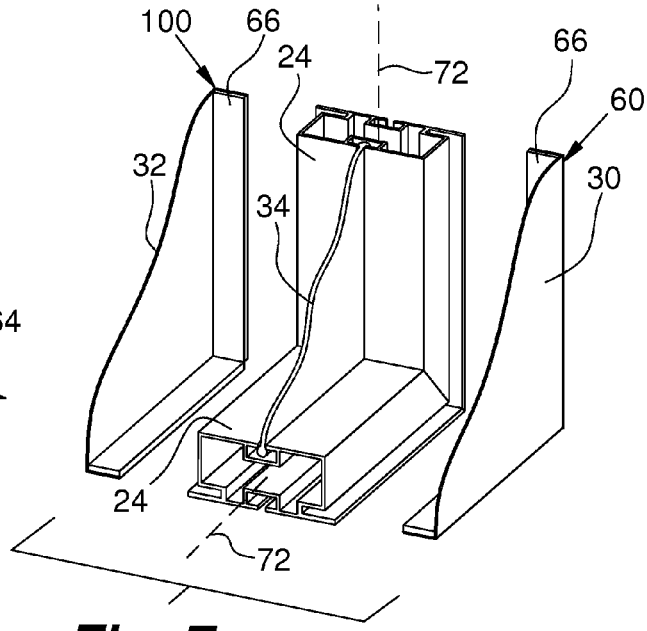
FIG. 7 is a partially exploded broken perspective view of the embodiment depicted in FIG. 6.

The frame member 24 may also include an inboard lipped channel 70 at the inboard portion 106. Alternatively or in addition, the frame member 24 may include an outboard lipped channel 76 at the outboard portion 108. As illustrated in FIGS. 6, 7 and 9, embodiments in which the frame member 24 includes an inboard lipped channel 70 may include an auxiliary member 34 being partially receivingly engaged by the inner lipped channel 70. This auxiliary member 34 may be, for example, a light source or sound absorption blanket. Outboard lipped channel 76 may also accommodate accessories such as lighting systems, wiring tracks and display support elements.

Frame members of certain embodiments may have longitudinal axes which are curved, resulting in the respective frame member itself being curved (not shown). Such a structure can be produced, for example, by way of a curved extrusion process. Further, embodiments of the dual panel-frame interface system may comprise two or more frame members. In such cases, the first panel member and second panel member of each such embodiment are in first releasable connection and second releasable connection, respectively, with each frame member. As illustrated in FIGS. 16-19, in embodiments (such as that shown generally at 116) which include four frame members (such as those shown at 24), the frame members can be rectangularly interconnected.

The detailed description of embodiments of the dual panel-frame interface system is intended to serve merely as examples, and is in no way intended to limit the scope of the appended claims to these described embodiments. Accordingly, modifications to the embodiments described are possible, and it should be clearly understood that the invention may be practiced in many different ways than the embodiments specifically described below, and still remain within the scope of the claims.

The invention claimed is:

1. A dual panel-frame interface system for use in constructing portable displays, said dual panel-frame interface system comprising:

(a) a frame member being elongated and hollow, and including a substantially constant cross-sectional profile, a first lateral wall, a first mounting groove disposed inwardly thereof with a first lateral opening disposed substantially thereat, said first lateral opening being disposed between said first lateral wall and a first distal groove wall, said first distal groove wall extending to a first distance outward of said first lateral wall and having a first distal face generally facing said first lateral opening; and (b) a first panel member including a first display portion, said first display portion having a first inner surface and a first outer surface, said first outer surface extending to a first panel peripheral edge, said first panel member being in first releasable connection with said frame member such that said first panel peripheral edge is approximately adjacent said first distal face, said first panel member is generally disposed outward from said first distal face, and said first lateral opening is visually obscured by said first panel member from a viewpoint outward of said first outer surface.

2. A dual panel-frame interface system as defined in claim 1 in which said first releasable connection is by way of either clinging engagement between said first lateral wall and said first inner surface, or receiving engagement between said first mounting groove and one or more mounting gaskets flexibly connected to said first panel peripheral edge.

3. A dual panel-frame interface system as defined in claim 2 in which said clinging engagement is achieved by way of one or more hook-and-loop fastener elements.

4. A dual panel-frame interface system as defined in claim 1 in which said first panel peripheral edge is approximately adjacent said first distal face at approximately said first distance.

5. A dual panel-frame interface system as defined in claim 1 in which said frame member further includes an inboard lipped channel.

6. A dual panel-frame interface system as defined in claim 5 further comprising an auxiliary member being partially receivingly engaged by said inboard lipped channel.

7. A dual panel-frame interface system as defined in claim 1 in which said frame member further includes an outboard lipped channel.

8. A dual panel-frame interface system as defined in claim 1 in which said frame member further includes a first proximal groove wall disposed inward of said first lateral wall and generally opposite said first distal groove wall.

9. A dual panel-frame interface system as defined in claim 1 comprising two said frame members, said first panel member being in said first releasable connection with each said frame member.

10. A dual panel-frame interface system as defined in claim 1 comprising four said frame members rectangularly interconnected, said first panel member being in said first releasable connection with each said frame member.

11. A dual panel-frame interface system as defined in claim 1 in which said frame member further includes a second lateral wall and a second mounting groove disposed inwardly thereof with a second lateral opening disposed substantially thereat, said second lateral opening being disposed between said second lateral wall and a second distal groove wall, said second distal groove wall extending to a second distance outward of said second lateral wall and having a second distal face generally facing said second lateral opening.

12. A dual panel-frame interface system as defined in claim 11 in which:

(a) said dual panel-frame interface system further comprises a second panel member including a second display portion, said second display portion having a second inner surface and a second outer surface, said second outer surface extending to a second panel peripheral edge;

(b) said second panel member is in second releasable connection with said frame member such that said second panel peripheral edge is approximately adjacent said second distal face, said second panel member is disposed generally outward of said second distal face, and said second lateral opening is visually obscured by said second panel member from a viewpoint outward of said second outer surface; and (c) said second releasable connection is by way of either clinging engagement between said second lateral wall and said second inner surface, or receiving engagement between said second mounting groove and one or more mounting gaskets flexibly connected to said second panel peripheral edge.

13. A dual panel-frame interface system as defined in claim 12 in which said first panel peripheral edge is approximately adjacent said first distal face at approximately said first distance, and said second panel peripheral edge is approximately adjacent said second distal face at approximately said second distance.

14. A dual panel-frame interface system for use in constructing portable displays, said dual panel-frame interface system comprising:

(a) a frame member being elongated and hollow, said frame member including a substantially constant cross-sectional profile and (i) a first lateral wall, a first mounting groove disposed inwardly thereof with a first lateral opening disposed substantially thereat, said first lateral opening being disposed between said first lateral wall and a first distal groove wall, said first distal groove wall extending to a first distance outward of said first lateral wall and having a first distal face generally facing said first lateral opening; and (ii) a second lateral wall and a second mounting groove disposed inwardly thereof with a second lateral opening disposed substantially thereat, said second lateral opening being disposed between said second lateral wall and a second distal groove wall, said second distal groove wall extending to a second distance outward of said second lateral wall and having a second distal face generally facing said second lateral opening; and (b) a first panel member including a first display portion, said first display portion having an first inner surface and a first outer surface, said first outer surface extending to a first panel peripheral edge, said first panel member being in first releasable connection with said frame member such that said first panel peripheral edge is approximately adjacent said first distal face at approximately said first distance, said first panel member is generally disposed outward from said first distal face, and said first lateral opening is visually obscured by said first panel member from a viewpoint outward of said first outer surface; and (c) a second panel member including a second display portion, said second display portion having a second inner surface and a second outer surface, said second outer surface extending to a second panel peripheral edge, said second panel member being in second releasable connection with said frame member such that said second panel peripheral edge is approximately adjacent said second distal face at approximately said second distance, said second panel member is disposed generally outward of said second distal face, and said second lateral opening is visually obscured by said second panel member from a viewpoint outward of said second outer surface.

15. A dual panel-frame interface system as defined in claim 14 in which (a) said first releasable connection is by way of either clinging engagement between said first outer face and said first inner surface, or receiving engagement between said first mounting groove and a plurality of mounting gaskets flexibly connected to said first panel peripheral edge; and (b) said second releasable connection is by way of either clinging engagement between said second outer face and said second inner surface, or receiving engagement between said second mounting groove and one or more mounting gaskets flexibly connected to said second panel peripheral edge.

16. A dual panel-frame interface system as defined in claim 15 in which said clinging engagement is achieved by way of one or more hook-and-loop fastener elements.

17. A dual panel-frame interface system as defined in claim 14 in which said frame member further includes an inboard lipped channel and an outboard lipped channel.

18. A dual panel-frame interface system as defined in claim 17 further comprising an auxiliary member being partially receivingly engaged by said inboard lipped channel.

19. A dual panel-frame interface system for use in constructing portable displays, said dual panel-frame interface system comprising:

(a) a frame member being elongated and hollow, said frame member including a substantially constant cross-sectional profile and (i) a first lateral wall, a first mounting groove disposed inwardly thereof with a first lateral opening disposed substantially thereat, said first lateral opening being disposed between said first lateral wall and a first distal groove wall, said first distal groove wall extending to a first distance outward of said first lateral wall and having a first distal face generally facing said first lateral opening;

(ii) a second lateral wall and a second mounting groove disposed inwardly thereof with a second lateral opening disposed substantially thereat, said second lateral opening being disposed between said second lateral wall and a second distal groove wall, said second distal groove wall extending to a second distance outward of said second lateral wall and having a second distal face generally facing said second lateral opening;

(iii) a first proximal groove wall disposed inward of said first lateral wall and generally opposite and parallel to said first distal groove wall; and (iv) an outboard lipped channel; and (b) a first panel member including a first display portion, said first display portion having a first inner surface and a first outer surface, said first outer surface extending to a first panel peripheral edge, said first panel member being in first releasable connection with said frame member such that said first panel peripheral edge is approximately adjacent said first distal face at approximately said first distance, said first panel member is generally disposed outward from said first distal face, and said first lateral opening is visually obscured by said first panel member from a viewpoint outward of said first outer surface, said first releasable connection being by way of either clinging engagement between said first outer face and said first inner surface, or receiving engagement between said first mounting groove and a plurality of mounting gaskets flexibly connected to said first panel peripheral edge; and (c) a second panel member including a second display portion, said second display portion having a second inner surface and a second outer surface, said second outer surface extending to a second panel peripheral edge, said second panel member being in second releasable connection with said frame member such that said second panel peripheral edge is approximately adjacent said second distal face at approximately said second distance, said second panel member is disposed generally outward of said second distal face, and said second lateral opening is visually obscured by said second panel member from a viewpoint outward of said second outer surface, said second releasable connection being by way of either clinging engagement between said second outer face and said second inner surface, or receiving engagement between said second mounting groove and one or more mounting gaskets flexibly connected to said second panel peripheral edge.

* * * * *